United States Patent [19]

Thierstein

[11] 4,024,045

[45] May 17, 1977

[54] MASTER PATTERN CYLINDER

[75] Inventor: Hans Thierstein, Wiler b. Utzenstorf, Switzerland

[73] Assignee: Fritz Buser AG Maschinenfabrik, Switzerland

[22] Filed: Mar. 4, 1976

[21] Appl. No.: 663,761

[30] Foreign Application Priority Data

Mar. 6, 1975 Switzerland ..... 2815/75

[52] U.S. Cl. ..... 204/281; 204/9; 204/11

[51] Int. Cl.[2] ..... C25D 1/08; C25D 1/20; C25D 17/00

[58] Field of Search ..... 204/9, 11, 281

[56] References Cited

UNITED STATES PATENTS

| | | | |
|---|---|---|---|
| 2,287,122 | 6/1942 | Norris | 204/11 |
| 3,763,030 | 10/1973 | Zimmer | 204/281 |
| 3,891,514 | 6/1975 | Klemm | 204/15 |
| 3,905,400 | 9/1975 | Du Pree et al. | 138/140 |

*Primary Examiner*—F.C. Edmundson
*Attorney, Agent, or Firm*—Weingarten, Maxham & Schurgin

[57] ABSTRACT

A matrix usable for producing perforated nickel sleeves and the method for making the matrix. The matrix comprises a roller body and a sleeve detachably surrounding the roller body, the sleeve being provided with conductive and non-conductive portions. The mating surface between the roller body and sleeve is disclosed as frustum-shaped, and alternatively as a cylinder.

6 Claims, 2 Drawing Figures

MASTER PATTERN CYLINDER

FIELD OF THE INVENTION

The invention relates to a matrix for producing perforated nickel sleeves by electrolytic deposition, the surface of the matrix being a sleeve detachable from the roller body and being provided with conductive and non-conductive portions.

DISCUSSION OF THE PRIOR ART

The manufacture of matrices or matrix roller used as the tool or mould for producing perforated nickel sleeves is known. The matrices are mainly produced from a roller body, to whose faces are welded terminal flanges and shaft journals. A cohesive copper coating is applied to the surface of the said roller bodies by electrolytic deposition. Impressions are made in the surface of this coating, that is, it is structured, by such means as embossing, engraving, etching or the like. Subsequently, the depressions formed on the surface of the copper coating by a treatment of this type are filled with an electrically non-conductive material, after which the whole surface is made smooth, for example by grinding or polishing.

A considerable capital investment is necessary for the manufacture of matrices, which cannot in fact be made without a comprehensive background knowledge and experience. However, the equipment and experience can only be fully economically utilized if a sufficiently large production of the perforated nickel sleeves can be ensured.

In order to give maximum independence of outside suppliers, it can be readily understood that companies wish to produce their own nickel sleeves, but hitherto the internal manufacture of matrices has generally failed due to the high investment cost and/or the lack of expert knowledge. It is in fact fundamentally possible to obtain the matrices from the screen printing machine manufacturer, but account must be taken of the fact that the life of the structured surface of the matrices is limited, resulting in frequent transportation to and from the manufacturer of relatively heavy rollers, leading to a correspondingly large amount of handling and relatively high costs. In addition, there is normally an irregular supply of rollers to be overhauled, leading to an unsatisfactory utilization of plant or to long delay time with the machine manufacturer. Therefore, a high capital investment for the rollers has been necessary, because a large number of rollers is always in the process of transportation or at the manufacturers for overhaul.

SUMMARY OF THE INVENTION

It is an object of this invention to so construct a matrix of the type described hereinbefore that the disadvantages linked with the hitherto known matrices are largely eliminated, whereby additionally the capital investment and the handling effort and costs can be reduced. This invention provides a matrix comprising a roller body and a sleeve surrounding the roller body, the sleeve being provided with conductive and nonconductive portions, whereby the inner surface of the sleeve and the surface of the roller body form an adhesive, but nondestructive detachable surface support.

BRIEF DESCRIPTION OF THE DRAWING

The objects, advantages and features of the present invention will be apparent from the following detailed description when taken in conjunction with the accompanying drawing in which.

DETAILED DESCRIPTION OF THE PREFERRED EMBODIMENT

Figure 1:
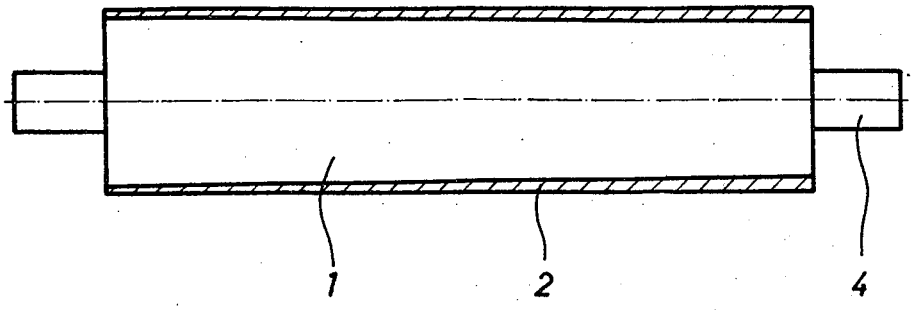
FIG. 1 is a sectional view of a first embodiment of a roller body with a fitted, thin-walled sleeve whose outer surface is cylindrical and whose inner surface is frustum-shaped.

FIG. 1 shows a roller body 1 equipped with shaft ends 4, whereby the outer surface of the said roller body 1 is frustumshaped, the cone being very steep, having a slope in the vicinity of 3,500–2,500:1. A thin-walled sleeve 2 is galvanically deposited on the outer surface of roller body 1. On the outer periphery, sleeve 2 is cylindrically machined, for example by turning and subsequent polishing. The surface of sleeve 2 on roller body 1 is structured by a suitable well-known treatment, so that it subsequently has the necessary conductive and nonconductive portions. Sleeve 2 may then be separated from roller body 1 and as a thin-walled sleeve can without difficulty be transported to the printer. The customer merely requires an equivalent roller body 1 for receiving sleeve 2, which is fitted onto the roller body and secured by suitable means.

Figure 2:
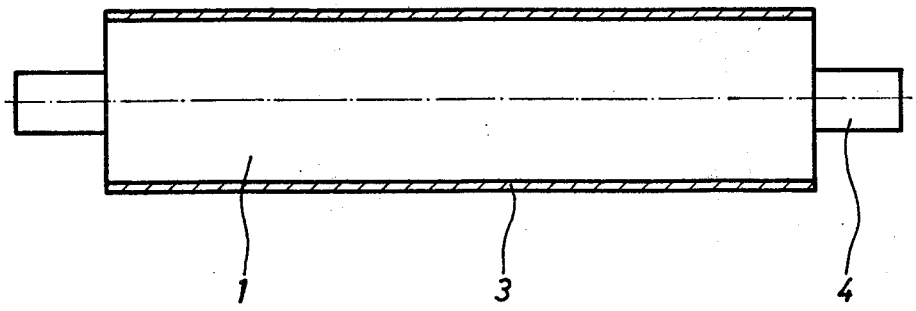
FIG. 2 is a similar sectional view of a further embodiment of a roller body with fitted thin-walled sleeve whose inner and outer surfaces are cylindrical.

The matrix according to FIG. 2 has substantially the same roller body 1 as in the embodiment of FIG. 1, whereby however, its outer surface is cylindrical. A sleeve 3 is galvanically deposited on roller body 1, where it is machined and structured as previously described. After separating sleeve 3 from roller body 1 this can be dispatched in the same way as sleeve 2.

The wall thickness of sleeves 2 and 3 is preferably between 2 and 4 mm. To facilitate the separation of sleeves 2 and 2 from roller body 1 a separating layer made from a suitable material such as chromium can be placed between these two members on the roller body by such means as galvanic deposition.

Whereas sleeve 2 separated from roller body 1 can again be fixed to an equivalent solid roller body, for example by frictional grip, it is advantageous to make the roller body 1 according to FIG. 2 expandable, such as by an internal overpressure. As a result sleeve 3, which is also cylindrical on the inside can easily be fixed to another equivalent roller body 1. If one of the sleeves 2 or 3 has a surface defect it can be removed and replaced by another one. The return transportation of the sleeve is unnecessary because its metal, preferably copper, can be reused in the vicinity of the place where the sleeve is used for its original purpose.

It is essential that the described matrix comprises two detachable portions 1 and 2 or 3, whereby these members can be disconnected from one another without there being any damage to the surface support of roller body 1. It must also be possible to remove the sleeve 2 or 3 in non-destructive manner from the surface support of roller body 1 when machining the sleeve 2 or 3 for providing electrically conductive and non-conductive portions. Furthermore, in operation when a surface defect occurs to the sleeve, the latter can be removed undamaged from the surface support of roller body 1, also without damaging the latter.

The invention is not limited to the embodiments described above and various modifications will likely occur to those skilled in this art which are within the scope of the invention.

What is claimed is:

1. A matrix usable for producing perforated nickel sleeves by electrolytic deposition, said matrix comprising:

a roller body; and a sleeve detachably surrounding said roller body and provided with electrically conductive and non-conductive portions:

whereby the inner surface of said sleeve and the surface of said roller body form an adhesive, but non-destructive detachable surface support.

2. The matrix according to claim 1 wherein said surface of said roller body and said inner surface of said sleeve are matching frustum-shaped surfaces with a slight slope.

3. The matrix according to claim 2 wherein said slope is in the range of 3500–2500:1.

4. The matrix according to claim 1 wherein said surface support is cylindrical and said roller body is expandable relative to said sleeve.

5. The matrix according to claim 1 and further comprising a separating layer of material between said roller body and said sleeve.

6. The matrix according to claim 5 wherein said separating layer is formed of chromium.

* * * * *